United States Patent [19]

Goodwin

[11] 4,014,539

[45] Mar. 29, 1977

[54] ANGULAR PATH SHEET CONVEYING

[75] Inventor: Eber Lyle Goodwin, Arlington Heights, Ill.

[73] Assignee: Addressograph Multigraph Corporation, Cleveland, Ohio

[22] Filed: Aug. 14, 1975

[21] Appl. No.: 601,008

[52] U.S. Cl. ..... 271/184; 193/35 R; 198/780; 271/225; 271/251

[51] Int. Cl.[2] ..... B65H 29/20

[58] Field of Search ..... 271/225, 184, 251, 80, 271/275, 273; 101/232; 270/20, 8; 193/35 R; 198/127 R; 29/132

[56] References Cited

UNITED STATES PATENTS

| | | | |
|---|---|---|---|
| 1,680,044 | 8/1928 | Hitchcock | 271/225 |
| 2,030,816 | 2/1936 | Fenton | 198/127 R |
| 2,593,089 | 4/1952 | Barry | 193/35 R |
| 2,964,161 | 12/1960 | Lopez | 271/225 X |
| 3,161,130 | 12/1964 | Vogel | 29/132 X |
| 3,401,930 | 9/1968 | Bishop | 271/225 |
| 3,658,322 | 4/1972 | Martin | 271/184 |

*Primary Examiner*—Evon C. Blunk
*Assistant Examiner*—Bruce H. Stoner, Jr.
*Attorney, Agent, or Firm*—Russell L. Root

[57] ABSTRACT

A conveyor is provided for accepting sheets moving in one direction from a duplicator and conveying them at an angle to the initial direction; e.g., 90°. The conveyor consists of rollers of relatively large diameter arranged with close spacing so that sheets of paper will pass easily from one to the other, and entering sheets will find fairly continuous support whatever their size. The rollers are set at an angle to the desired feed path to provide an effect urging the sheets towards a side alignment stop and the construction is such that the angular roller setting may be readily made during manufacture, to act towards whichever side of the feed path is selected as the one to carry the alignment stop surface. Means are provided for controlling the sheets during transfer from one conveyor to the other, and for instantaneous acceleration in the second direction by the roller conveyor, permitting handling of closely spaced sheets at high sheet frequency without danger of interference between adjacent sheets which might result in jamming.

3 Claims, 8 Drawing Figures

18
4
4
50
52
60
62
64
66
68
70
72
74
76
78
82
84
86
88
90
92
94
96
98
100
102
104
106
108
110
118
120
122
128
130
132
134
136
138
140
142

ANGULAR PATH SHEET CONVEYING

BACKGROUND OF THE INVENTION

This invention relates to sheet handling and particularly to the conveying of paper sheets between two portions of a duplicating system. This may be between a first printing head and a second printing head or between a printing head and another device, such as a collator.

It has been discovered that much operator efficiency can be obtained by arranging certain paper paths in a duplicating system at angles to each other as explained in my copending application Ser. No. 600,992 entitled HIGH OPERATOR EFFICIENCY DUPLICATING SYSTEM. The angle is normally 90°, although some variation from this up to about 20° in either direction can normally be accomodated if required.

In order to do this, the paper sheets must be handled at high speeds, and in a duplicating environment they inherently travel in close array, often in the range of 5000 to 10,000 sheets per hour with an intersheet spacing of 1 to 16 inches. To accomplish path direction changes at this speed and spacing without interference between sheets in the stream is recognized as extremely difficult.

While the present invention is described mainly in terms of a lithographic duplicator, it will be understood that its principles are applicable to any type of printer or duplicator, such, for example, as high-speed electrophotographic equipment, and when the terms "printer," "duplicator" and "duplicating system" are used hereinafter, all types of reprographic equipment are embraced.

SUMMARY OF THE INVENTION

I have discovered that by feeding the sheets from a source (such as a printing head) on a first conveyor whose terminus is slightly higher than the surface of a special second conveyor, positioned at an angle to the first conveyor, the requisite speed of transfer can be achieved.

The second conveyor requires special properties to receive each sheet smoothly by gravity from the first conveyor and convey it away reliably once received. These properties are provided by a second conveyor consisting of a series of parallel rollers of relatively large diameter and closely spaced, with their axes extending generally parallel to the first path and generally normal to the second, the rollers of the second conveyor being power driven at the sheet conveyance speed required by the duplicator.

There are also provided means for quickly establishing and maintaining driving contact between the rollers and the sheet, while at the same time minimizing the possibility of ink set-off to the machine parts in case the duplicator is of the wet ink variety, and stop means for aligning the sheet with the new path, against which aligning means the sheet is urged by a slight cant to the rollers.

Means are also provided for maintaining a general or partial control over the flying sheets during the transfer operation.

Because it may be desirable to have the sheet carried away from the first path in either one direction or the other, the second conveyor is so designed that the means for providing the roller cant to drive the sheet against the aligning stop includes a novel arrangement which allows the conveyor to be built of either hand without significant differences in the parts used.

DISCUSSION OF THE PRIOR ART

The only construction of which I am presently aware, which has significant pertinence to the present situation, is an arrangement embodied in a sheet folder manufactured by Roneo Vickers Hadawe, Ltd. A first folding head folds a paper sheet once or twice, and this folded sheet is fed to a roller conveyor running at an angle to the path of sheets issuing from the first folding head. The folded sheets are carried thereby to a second folding head where a fold normal to the first fold or folds can be made.

The roller conveyor embodied in this organization is dealing with a situation distinct from that presently under consideration in that the articles being transferred are, in fact, fairly rigid objects by reason of the fold or folds having been formed therein. The rollers of the conveyor are rubber covered, are perhaps 0.625 inches in diameter, and are placed on about 2-½ inch centers so as to be roughly 2 inches apart at their points of nearest approach. As disclosed by the Roneo Vickers Hadawe construction there is no implication that broad flexible paper sheets issuing from a duplicator could receive a successful high-speed direction change by way of such a roller conveyor.

In particular, the folded sheet issuing from the first folding head in the prior art device is speeded up, especially on the roller conveyor, to a point such that the sheet on the conveyor is well out of the way when the next folded sheet is presented. This is feasible because the folded sheets can withstand much more force than unfolded sheets when striking a fixed stop.

In a duplicator situation, where there is not only the register stop on the roller conveyor but also either a register stop on a second printing head or the pocket walls on a sheet distributor, as in the present invention, the normal weight, single thickness sheet of paper being handled must approach any such stop surface at no more than a predetermined limiting speed to avoid mutilating the edge.

This surface speed limitation would be inconsistent with the concept, present in the Roneo Vickers Hadawe equipment, of moving the sheets around the corner without overlap at the turning point, and hence renders the use of the roller conveyor aspect of that equipment apparently unsuitable for duplicator applications.

DESCRIPTION OF THE PREFERRED EMBODIMENT

Figure 1:
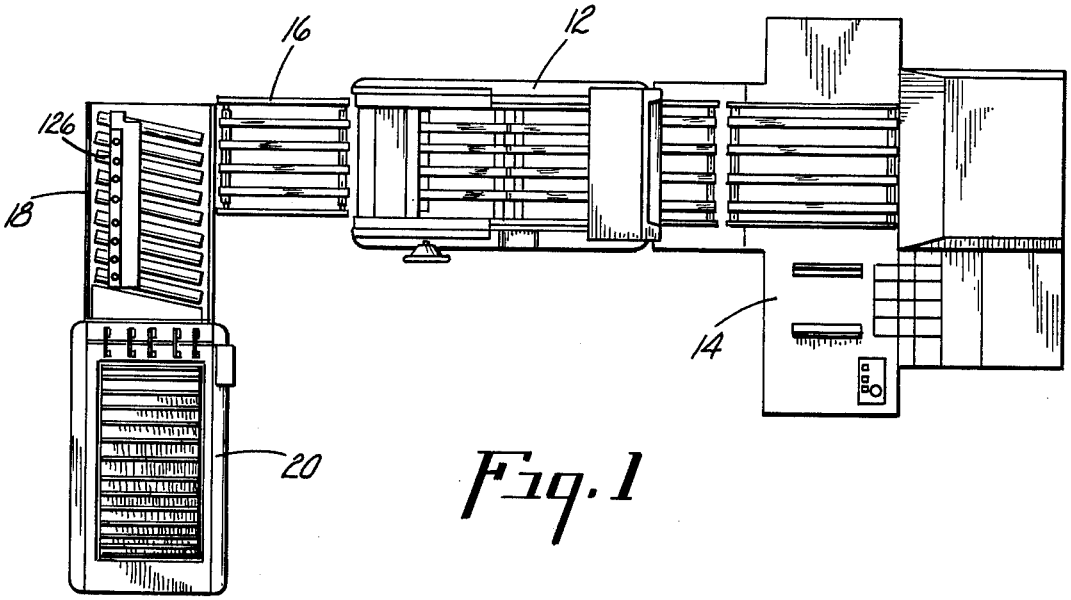
FIG. 1 is a plan of a duplicating system employing the present invention and embodying a first conveyor and a second conveyor.

In the plan view of FIG. 1 can be seen a duplicating system 10 which in the form shown is a MULTILITH Model 2850 lithographic offset duplicator 12, to which is connected a master maker 14 for preparing lithographic masters from original documents by the electrostatic process in a known manner.

As the copy sheets exit from the printing couple of the duplicator 12, they are transported away by a first conveyor shown as a belt conveyor 16.

Just beyond the end of the belt conveyor 16 is a second conveyor 18 which accepts sheets from the belt conveyor and moves them in a direction substantially normal to their original direction and presents them to a collator 70 which is shown as being of the rotary drum type.

As explained in my copending application Ser. No. 600,992, filed Aug. 14, 1975 there are certain distinct advantages in placing the sheet travel paths of the duplicator and the collator substantially normal to each other, concerned generally with operator convenience leading to higher productivity by the operator of the duplicating system.

One of the perceived difficulties in attempting to implement this principle, however, was the high speed at which copy sheets issue from a modern lithographic duplicator as well as other types of duplicators; i.e., on the order of 7500 to 10,000 copies per hour with, in some cases, very little space between copies. Trying to redirect these copy sheets in a path substantially normal to the path on which they issue initially has not been deemed feasible on an economic basis because of the high risk of interference and jams at the redirection location.

To be sure, manipulation of the sheets to gain wider separation and better individual control is mechanically feasible, but such constructions involve not only equipment expense, but require substantial additional floor area which is usually an unacceptable feature from the standpoint of the customer's space requirements.

According to the present invention it has been discovered that a particular configuration of conveyor, when adopted for use at the second conveyor location (i.e., conveyor 18) solves the foregoing enigma and makes possible the change of sheet direction in a practical and economic manner without increasing the danger of sheet jams on the one hand, while still satisfying the important and practical economic and space requirement restrictions on the other.

Figure 3:
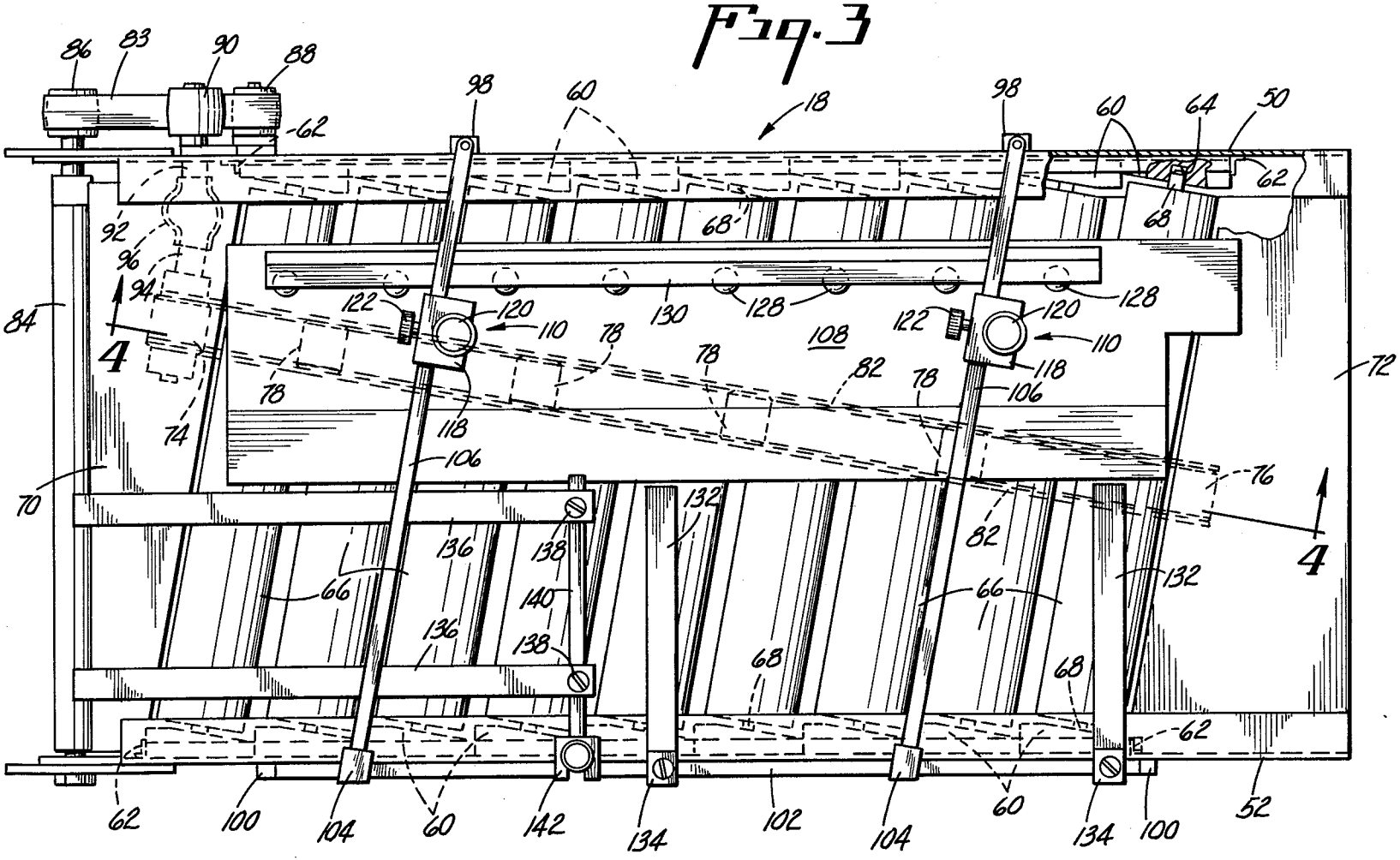
FIG. 3 is a top plan to a larger scale, with parts broken away, of the second conveyor including the means for generally controlling motion of the flying sheets.
Figure 4:
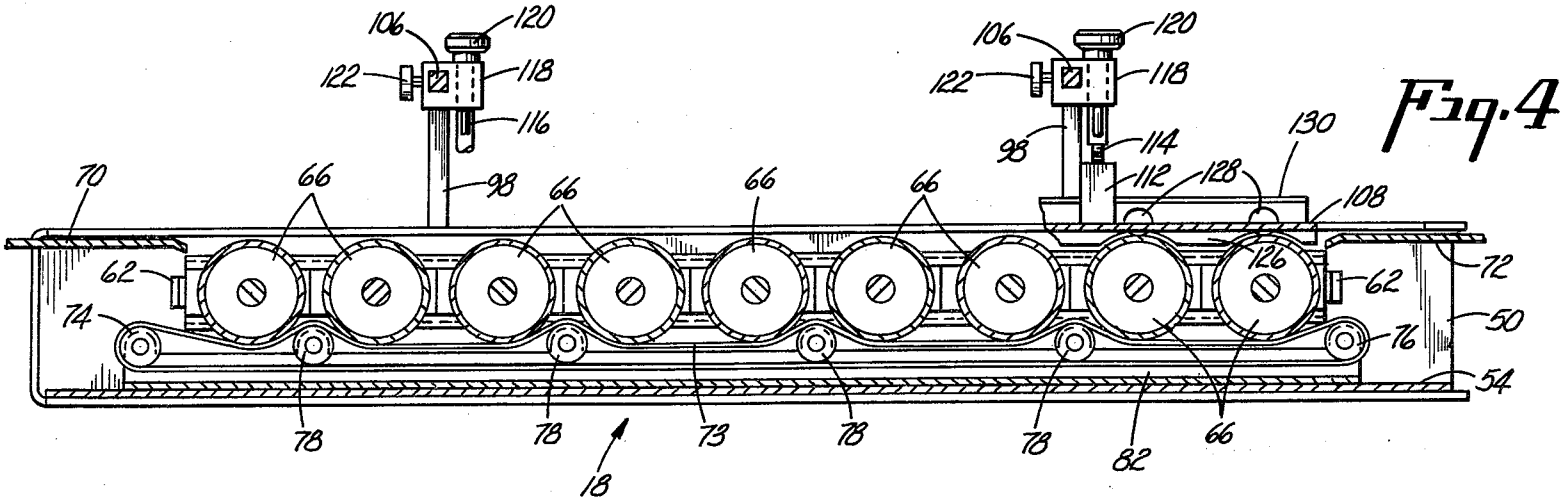
FIG. 4 is a longitudinal section of the device of FIG. 3, taken substantially on line 4—4 of FIG. 3 with parts broken away.
Figure 5:
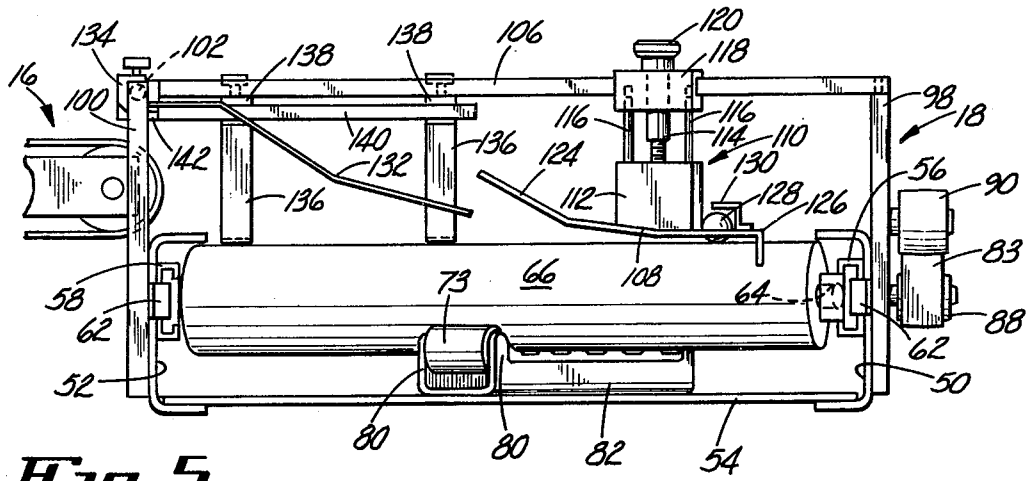
FIG. 5 is an end elevation of the device of FIG. 2, also including a fragmentary showing of the first conveyor in side elevation.

This conveyor is shown in detail in FIGS. 3, 4 and 5, and comprises a frame including side channels 50 and 52 connected by a bottom plate 54. Slideways 56 and 58 are mounted on the inner surfaces of the channels 50 and 52 respectively.

A series of identical bearing blocks 60 are mounted in the slideways and fastened therein by end stops such as 62. Each block has a bore 64 (FIGS. 3 and 5) which serves as a bearing to receive the journal of a roller, the axis of which extends at a slight angle to the direction normal to the longitudinal axis of the conveyor frame, in this case at an angle of about 10°. Each bore 64 is in alignment with a corresponding bore of another bearing block 64 on the opposite side of the frame and each corresponding pair supports between them for free rotation a roller 66 whose journals 68 are received in the bores 64.

At each end of the conveyor frame at its upper surface there is mounted a guide plate with one angled edge (see plates 70 and 72) matching the roller angle, which plates act as support surfaces for sheets and lie substantially in a plane which is the common tangent to the upper elements of the roller surfaces to support the sheets at either end of the roller system as they approach or depart.

In the preferred form shown, the rollers are about two inches in diameter and they are placed on about 2-½ inch centers so that, at points of closest approach, their surfaces are about ½ inch apart. In carrying out the present invention it is found that the roller diameters should be between about ½ inch and 3 inches in diameter, with the space between roller surfaces no more than about one-fourth of the roller diameter in order to insure successful performance. Space and weight considerations would tend to suggest use of rollers of smaller diameter, while cost and manufacturing consideration would suggest the use of fewer rollers of larger diameter. The optimum for most purposes, therefore, appears to be the preferred form shown, wherein nine rollers are found to perform acceptably for sheets of the usual sizes. For the purposes of the present discussion the expression "closely spaced rollers" will be understood to indicate an assembly in which the roller spacing the roller diameters are in the ratio above-indicated or a smaller ratio, and this language will be so interpreted wherever used herein.

The surfaces of rollers 66 are of metal and preferably are chrome-plated so as to resist transfer of ink, since sheets exiting from a duplicator may have printing on the lower face as well as the upper, and if the ink had not entirely dried, light line contact between the roller surface, when plated as described, offers only miniscule chance for smuding or offset.

The rollers 66 are powered by a friction belt 73 which runs beneath the rollers, the belt being trained around end pulleys 74,76, and over intermediate pulleys 78 which project upward between adjacent rollers 66 to provide a certain amount of driving wrap of the belt thereagainst. All of the rollers 74, 76 and 78 are supported for rotation on bearing ears such as 80 (FIG. 5) formed on a channel 82 secured to the bottom member 54 of the frame. The belt 73 is preferably of somewhat resilient material so as to remain taut and thereby maintain driving tension at all times.

The pulley 74 may be driven in any suitable manner, either by an individual electric motor or, as shown in the present drawing, by a drive connection from the power source within the collator 20. This is accomplished, as seen in FIG. 3, by a belt 83 which is driven from a shaft 84 which forms a part of the collator and receives its power therefrom. The belt 83 is trained over pulley 86 on the shaft 84 and over an idler 88, to drive a pulley 90 connected with a stub shaft 92 which has a driving connection with a shaft 94 associated with pulley 74 through any simple angle drive connection. for example, the relatively stiff but still somewhat flexible sleeve 96.

The drive ratios are so selected that the surface speed of the rollers 66 is at least equal to that of the conveyor 16 on a sheet frequency basis. That is to say, the same number of sheets per unit time will be independently forwarded in a stream of spaced sheets as were forwarded by the conveyor 16. It will be understood that if the sheets are first fed lengthwise on conveyor 16, and then long edge foremost on conveyor 18, or if there is substantial spacing between sheets initially, it is possible that the spacing between sheets may be allowed to collapse somewhat, and that the conveyor 18 may operate at a slightly slower surface speed than conveyor 16. However, on a sheet frequency basis they must, of course, be equal and for practical purposes it is usually preferable to have the rollers 66 travel at a surface speed at least equal to that of the conveyor 16, and more generally at a somewhat higher surface speed.

It is important to note, however, that the speed of the sheets emerging from the belt conveyor 16 must not exceed a certain value depending on the type of paper being fed, in order that the sheet edges shall not be mutilated as they strike the register guide and aligning stop 126 which will be presently described in detail. For sheets of ordinary weight, say 20 pound bond, this value is perhaps 350 ft. per minute. This maximum value of sheet speed is referred to hereinafter as the limiting stop engagement speed and is determinable by test for any particular paper. A safe value for most sheets would probably be about 275 ft/min which may be called the nominal limiting stop engagement speed for general purpose machines. Machines handling sheet stock in a restricted weight range would, of course, be compatible with a different readily determinable value of nominal limiting stop engagement speed. While the surface speed of the rollers 66 can exceed this speed somewhat, consideration must be had for the fact that the sheet will be passing directly into a feed-in conveyor of a sheet distributing device 20 so that the speed of the rollers 66 of the roller conveyor 18 must be kept within a range such that the change or slowdown to at least the limiting stop engagement speed will not be too drastic and hence introduce a further possible jam inducing situation.

An important feature of my invention is the construction of the second conveyor 18 using the individual canted bearing blocks 60 previously described. As seen in FIG. 1, the sheet makes a left turn as it emerges from the duplicator. If it is desired to have the sheet make a right turn, the 10 ° angle of the roller axes away from the initial path direction, would need to be reversed in order to properly urge the sheet against the register stop. With my construction this can be readily taken care of during construction with minimum change of conveyor design, by merely repositioning the slideways 56 at the proper location on the interior of the channels 50, 52, and then inverting the bearing blocks 60 as they are placed into the channels so as to give an opposite cant to the rollers, plus changing the angle of the channel 82, and adjusting the locations of the scaffold supported elements to be presently described. Thus, a conveyor of opposite hand can be constructed very readily with only the most nominal changes in design.

As illustrated in FIG. 5, the relationship of the first conveyor 16 and the second conveyor 18 is such that the exit point of conveyor 16 is substantially flush with the ends of rollers 66 and a short distance (e.g. between 1 and 2 inches) above their uppermost elements.

It can be seen from FIG. 5 that, as the sheet being transferred from one conveyor to the other is making the transition, it is temporarily in a flying condition and not under strict control. In order to meet this situation, the apparatus according to the present invention embodies several instrumentalities to be presently described.

To carry and properly position these instrumentalities, there is provided supporting scaffolding including two uprights 98 affixed to the side channel 50, and two uprights 100 affixed to the side channel 52 of the frame.

Between uprights 100 is mounted a horizontal beam 102, and the latter supports collars 104. Between the top of each upright 98 and each collar 104 there is swung a horizontal beam 106, and collars 104 being so set on beam 102 that the beams 106 are parallel to the axes of rollers 66.

The purpose of the two beams 106 is to support a chute-forming guide plate and register guide 108, and the latter has attached thereto a pair of support connections 110. Each such connection includes a block 112 with an upwardly pojecting screw 114 and a pair of upwardly projecting guide pins 116. The guide pins are slidably received in matching openings in an upper block 118 slidable on the beam 106. This upper block also carries a captive nut 120 which threadedly receives the screw 114 and serves to adjust the height of the chute above the rollers 66. A clamp screw 122 (FIG. 3) retains the block in desired position on its beam 106, and allows adjustment of the register guide laterally of the conveyor 18.

As can be seen in FIG. 5, one margin 124 of the guide plate 108 is flared upwardly to form with the roller surfaces the receiving mouth of a chute for funneling the lead edge of an incoming sheet to the proper location. The opposite margin of member 108 is turned downardly as indicated at 126 to form a stop surface for registering the sheet and orienting it in the proper direction, and is referred to herein as a "register guide" or "aligning stop." The lower edge of the margin 126 is configured to conform generally to the surfaces of rollers 66 as seen in FIG. 4.

Adjacent the register guide 126, the member 108 is provided with a series of openings which are slightly smaller in diameter than balls 128 which rest therein. The balls are preferably of steel or other material of substantial density, are preferably of stainless steel or are chrome-plated to resist ink offset, and are positioned one above each roller 66 to urge the margin of a sheet of gravity into driving contact with the underlying roller. A retainer bar 130 prevents the balls from becoming dislodged from their openings. It can be seen that the balls 128 simultaneously provide for two separate functions. They constitute, in effect, a means cooperating with the roller surfaces for both readily accepting a sheet between themselves and the roller surfaces when the sheet is thus projected by the first conveyor, and for establishing instantaneous driving connection between such interposed sheet and the roller surface for moving the sheet promptly along the second conveyor. By reason of their point contact and freedom to roll in any direction, as well as their direct cooperation with a curved roller surface, and the above-noted material of the ball surface, these balls contribute importantly to the ability of the equipment to handle sheets recently printed with wet ink under conditions such that offset of ink to the conveyor parts is prevented or drastically minimized.

To lead a flying sheet into the mouth of the chute formed by the guide plate 108 and the upper surfaces of the rollers 66 (see FIG. 5), there are provided two sheet deflectors 132, each adjustably positionable on the beam 102 by means of its connecting clamp 134.

The immediately foregoing description identifies the means for partially controlling a sheet as it leaves the first conveyor and arrives at the second. As seen in FIG. 5, the sheet moves from the left and has its lead edge properly directed by the sheet deflectors 132 in a slightly downwardly direction so as to be presented beneath the lip of the guide plate 108, which then continues its guidance until the lead edge strikes the aligning stop 126 with the adjacent margin underlying the balls 128 in driving contact with the surface of rollers 66, whereby the sheet propulsion in the new direction is promptly initiated.

As the sheet starts to move along the second conveyor (away from the viewer in FIG. 5 and towards the left in FIG. 3), the portion last arriving may still be elevated somewhat out of contact with the roller surfaces, and to insure prompt contact there is provided a second set of sheet deflectors 136. These may be either cantilevered bars similar to the deflectors 132, or flexible metal straps with their free ends rising lightly by gravity on the surfaces of rollers 66. In any case they are mounted by means of connecting clamps 138 on a cantilevered beam 140 adjustably affixed to the beam 102 by a mounting clamp 142. These sheet deflectors rapidly funnel the new lead edge of the sheet promptly into contact with the roller surfaces and hold the passing sheet in such contact as it moves towards the left in FIG. 3.

STATEMENT OF OPERATION

Referring particularly to FIGS. 1 and 3, it will be seen that the sheets in FIG. 1, will issue rapidly towards the left from the duplicator 12. For the sake of this discussion it will be assumed that the duplicator is producing 8-½ × 11 inch sheets at a rate of 7500 per hour with about a 3 inch interval between sheets.

The stream of sheets proceeds along the conveyor 16 at a rate of approximately 2-½ feet per second, and each in turn is thrust onto the conveyor 18. At this point it is quickly funneled into contact with the surfaces of rollers 66 where its margin is held by the balls 128, whereupon the sheet instantaneously begins its travel along the conveyor 18 (downwardly in FIG. 1). The sheet may not be instantaneously aligned with the conveyor 18 as it arrives since it must fly from one conveyor to the other, but the cant of the rollers 66 forces the sheet against the register guide 126 to straighten it out in a very short travel distance of an inch or two. As described above, the sheet, now moving along conveyor 18, is promptly forced against the rollers by the second set of sheet deflectors 136. These latter deflectors, while not essential, provide additional control for the sheet and are presently deemed desirable additions.

It can be readily seen that at the speeds and spacing imposed by the duplicator function and the sensitive character of the sheets being handled, unacceptable interference between adjacent sheets at the conveyor junction seems inevitable. In spite of this obvious barrier to success, I determined by a series of experiments that with the arrangement above described the sheets could be made to pass each other without interference and with the utmost reliability in spite of a significant overlap as they pass each other. This interaction of the sheets as they make the change in path direction can be seen approximately in FIGS. 2*a* – 2*d* which show the progression at very short intervals.

Figure 2A:
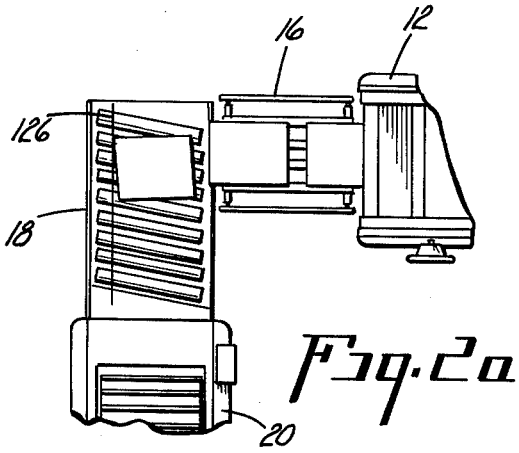
FIGS. 2a to 2d are fragmentary, somewhat schematic plan views illustrating the operation of the invention and showing the sheets in four progressive positions separated by short sequential time intervals.
Figure 2B:
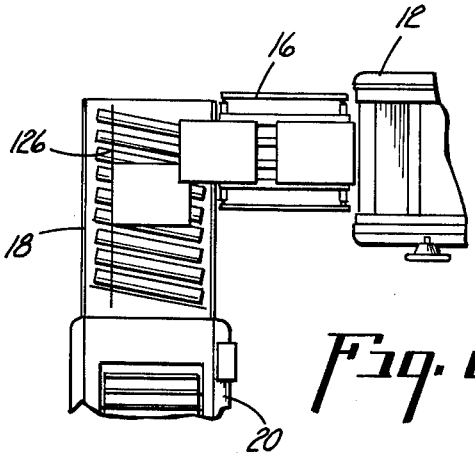
Figure 2C:
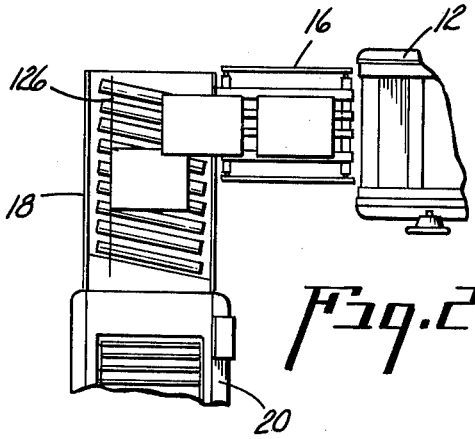
Figure 2D:
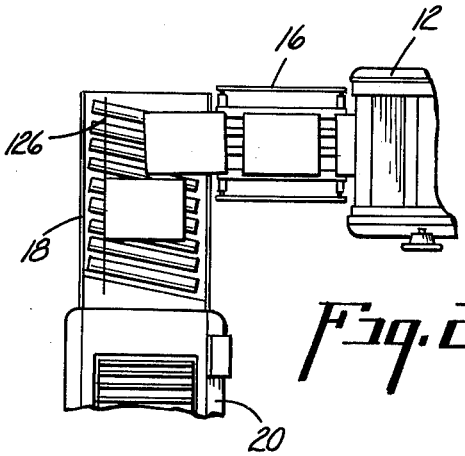

FIG. 2a (occurring at time T) shows the sheet position just as the first sheet reaches the register guide 126 (diagrammatically indicated). A moment later (say at time T + 0.13 sec.), FIG. 2*b* shows the second sheet having moved partially over the first sheet, while the first sheet has straightened itself against the register guide 126. FIG. 2*c* illustrates the situation at approximately time T + 0.22 sec. with the sheets still overlapping, and FIG. 2*d* illustrates the situation at about time T + 0.26 sec. when the first and second sheets have just cleared. This transition is repeated over and over with each succeeding pair of sheets, and with the utmost reliability, making possible the path direction change in a very restricted compass without exceeding acceptable sheet speeds.

As will be seen from the foregoing description, the problems solved by this invention relate mainly to the speed and spacing at which the sheets are being handled. It is generally above the sheet frequency of 5000 sheets per hour that the problems of moving thin paper sheets in an angular path arise, and especially where the path length between the turn and the next sheet stop must be short. In the present instance, this latter distance is about 3 to 4 feet. As previously explained, a nominal limiting stop engagement speed is a recognized limitation from the standpoint of prevention of sheet edge mutilation when encountering stops. However, to insure sheets traveling at normal spacing intervals around a corner without overlap, sheet speeds in excess of this are always required. Rapid acceleration and deceleration of sheets as well as manipulation and guiding of sheets above nominal limiting stop engagement speed are conditions which contribute materially to interruptions and jams and are hence to be avoided in any way possible. By means of the particular conveyor arrangement described herein with closely spaced rollers fed from above, I have discovered that overlap at the turn can be tolerated even at high rates of sheet frequency, and that conflict and jams do not ensue, thereby allowing sheet feed speeds in feet per minute to be held within effective limits.

What is claimed is:

1. A duplicator system comprising:

a duplicator including a printing couple for producing printed copy sheets, at least letter size, at a frequency of at least 5,000 per hour;

a work station for working on the printed copy sheets issuing from the duplicator; and transfer means for conveying printed copy sheets from said duplicator to said work station including:

a. a first conveyor for moving the completed copy sheets in a path away from the printing couple at production frequency with at least some spacing between sheets;

b. a second conveyor arranged adjacent the outlet of said first conveyor for carrying the copy sheets in a path away from the first conveyor in a direction substantially normal to the first conveyor path; said second conveyor comprising:

1. a plurality of closely spaced power driven rollers operating at a surface speed sufficient to maintain sheet frequency of said first conveyor with at least some sheet spacing, the upper surface of said rollers being substantially lower than the outlet of said first conveyor;

2. a sheet stop and alignment guide parallel to the path of said second conveyor, against which each sheet is cast by the first conveyor, said rollers also being canted in a direction to urge a sheet into contact with said alignment guide;

3. means cooperating with the roller surfaces for both readily accepting a sheet between itself and the roller surfaces when thus projected by the first conveyor, and for establishing substantially instantaneous driving connection between such interposed sheet and the roller surfaces for moving the sheet promptly along the second conveyor; and 4. a sheet deflector so positioned as to be out of the path of a sheet entering the second conveyor, but to coact with the sheet as it starts to move in its new direction powered by the rollers so as to urge the sheet progressively into a roller contacting drive receiving position.

2. A conveyor for receiving a sheet moving in a first direction and changing its motion to a second direction substantially normal to said first direction, comprising:

a. a frame including two longitudinal frame members;

b. an array of parallel, closely spaced rollers extending between said longitudinal frame members generally normal thereto but canted slightly in one direction;

c. power means for driving the rollers; and d. sheet control and guide means cooperating with said rollers comprising:

1. overhead supports mounted on said frame and including at least one beam extending parallel to said rollers;

2. a guide plate and register bar supported on and depending from said beam and adjustable therealong, said guide plate having a raised sheet entrance portion;

3. a series of balls carried by said guide plate and register bar, each ball resting on one of said rollers to urge a sheet into driving engagement therewith; and 4. a second beam mounted on said overhead supports and extending along one side of the conveyor, and a sheet deflector mounted cantilever-fashion on said beam and extending towards said guide plate with its free end at a lower level than the raised entrance portion of the guide plate to guide incoming sheets therebeneath.

3. A conveyor as set forth in claim 2 which further includes a beam mounted transversely of the conveyor and another sheet deflector extending along the conveyor in the direction of sheet movement, so positioned as to be out of the path of an entering sheet, but to coact with the sheet as it starts to move along the conveyor powered by the rollers.

* * * * *